US006324377B2

(12) United States Patent
Ando et al.

(10) Patent No.: US 6,324,377 B2
(45) **Date of Patent: *Nov. 27, 2001**

(54) IMAGE FORMING APPARATUS, PAPER BUNDLING APPARATUS, AND PAPER BUNDLING METHOD USING IMAGE FORMING APPARATUS

(75) Inventors: Ryo Ando; Toshiyuki Kazama; Hirotaka Mori, all of Ebina (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/455,781

(22) Filed: Dec. 7, 1999

(30) Foreign Application Priority Data

Feb. 17, 1999 (JP) ..... 11-038158

(51) Int. Cl.[7] ..... G03G 15/00; B65H 9/16

(52) U.S. Cl. ..... 399/395; 271/251; 399/408

(58) Field of Search ..... 399/395, 396, 399/407, 408; 271/226, 248, 250, 251, 252

(56) References Cited

U.S. PATENT DOCUMENTS 4,426,073 * 1/1984 Mizuma ..... 271/251
4,482,147 * 11/1984 Hibi et al. ..... 271/229
4,640,611 * 2/1987 Ohdake et al. ..... 399/408 X
4,676,498 * 6/1987 Kanemitsu et al. ..... 271/251
5,065,998 * 11/1991 Salomon ..... 271/251
5,086,319 * 2/1992 Carolan ..... 399/396
5,162,857 * 11/1992 Higeta et al. ..... 355/309
5,253,862 * 10/1993 Acquaviva et al. ..... 271/251
5,316,288 * 5/1994 Fish et al. ..... 271/250
5,461,469 * 10/1995 Farrell et al. ..... 399/407
5,657,983 * 8/1997 Fisk ..... 271/251
5,697,609 * 12/1997 Williams et al. ..... 271/228

* cited by examiner

*Primary Examiner*—Fred L Braun
(74) *Attorney, Agent, or Firm*—Oliff & Berridge, PLC.

(57) ABSTRACT

An image forming and paper bundling device and method for bundling the paper that is able to accurately correct the skew of a paper sheet independent of the shape or cutting accuracy of the paper sheet. The image forming apparatus includes an image forming unit for forming an image on the paper sheet, a paper transfer unit for transferring the paper sheet towards the image forming unit, and a skew correcting unit for correcting the skew of the paper sheet being transferred. The skew correcting unit making correction of the paper sheet with reference to an end of the paper sheet that is parallel to the paper transfer direction. The skew correction unit making the correction by urging an end of the paper sheet towards a reference guide as the paper sheet travels through the skew correction unit. A register control portion moves in a direction perpendicular to the path of the paper sheet to register the sheet to a predetermined position.

11 Claims, 8 Drawing Sheets

IMAGE FORMING APPARATUS, PAPER BUNDLING APPARATUS, AND PAPER BUNDLING METHOD USING IMAGE FORMING APPARATUS

BACKGROUND OF THE INVENTION

1. Field of the Invention

The present invention relates to an image forming apparatus such as a copying machine or a printer for forming and outputting an image on a paper sheet by utilizing the electrophotography.

The present invention relates further to a paper bundling apparatus and a paper bundling method for making a bundle of paper sheets having images produced.

2. Description of the Prior Art

In the image forming apparatus utilizing the electrophotography, generally speaking, the image is produced on the paper sheet by forming an electrostatic latent image corresponding to image signals on a photosensitive member, by transferring a toner image developed from the latent image to the paper sheet and then by fixing the transferred toner image on the paper sheet.

Here in this image forming apparatus, usually, paper sheets stacked on a feed tray are fed one by one and are transferred to a toner image transfer position. During the transfer, however, the paper sheets being transferred may be inclined by various factors (such as an assembling accuracy of mechanical parts, or a slipping phenomenon). If, in this case, the paper sheets are delivered at the inclination to the transfer position, the image is produced with a shear on the paper sheets.

In some image forming apparatus, therefore, there is assembled in a paper transfer line a mechanism for correcting the shear due to the inclination (as will be called the "skew") of the paper sheet being transferred. Specifically, as shown in FIG. 14, the mechanism is provided with two paper transfer rollers A and B which are disposed along the transfer direction of paper sheet P. The position of this paper sheet P is corrected with respect to the leading end of the paper sheet P being transferred, by bringing the paper sheet P conveyed by the upstream paper transfer roller B into abutment against the downstream paper transfer roller A stopped, so that the skew component may be corrected.

In the image forming apparatus described above, however, the paper sheet P takes a generally straight advancing direction if its leading end is correctly cut at about 90 degrees with respect to the transfer direction, as shown in FIG. 15(*a*). If the leading end of the paper sheet P is not correctly out at about 90 degrees, as shown in FIG. 15(*b*), the paper sheet P is angularly changed by correcting the skew component so that it is conveyed at the inclination. In short, the aforementioned image forming apparatus may fail to correct the skew regularly depending upon the cut angle of the leading end of the paper sheet.

This failure may invite the following problems when an image is to be produced on a paper sheet.

The paper sheet to have an image produced by the image forming apparatus frequently changes its shape delicately from a rectangular shape into a parallelogram due to the cutting error or the like. As shown in FIG. 16(*a*) or 16(*b*), therefore, the paper sheet P is gradually shifted sideway by correcting the skew when it is transferred. Here, the position to produce an image G is always generally fixed irrespective of the shift of the paper sheet P so that the image G goes out of position on the paper sheet P.

When the cutting accuracy of the paper sheet P is poor, more specifically, it is conceivable that a shear occurs in the paper sheet P and in the position to produce the image G so that the image G produced, as shown, extrudes from the paper region thereby to degrade the quality of the image production. Even if the paper cutting accuracy is not so poor, on the other hand, the region set near the paper ends to bear no image (as will be called the "marginal regions") may increase/decrease depending on the position of the paper end. If, in this case, the marginal regions become smaller a certain limit, the toner material may scatter to stick to the portions of the paper other than the image forming portions thereby to degrade the image forming quality seriously.

If the correction of the skew component is adversely affected by the cutting angle at the leading end of the paper sheet, on the other hand, the following problems may occur in the image forming apparatus having a function to produce images on the two sides of a paper sheet.

In this image forming apparatus, images are usually produced on the two sides of a paper sheet by forming an image at first on one side and then on the other side after the paper sheet was reversed. At this time, however, most image forming apparatuss are restricted to reverse the front and back sides of the paper sheet while interchanging the leading and trailing ends at the transfer time of the paper sheet by the size and cost of the apparatus and so on.

When the paper sheet P having a shape, as shown in FIG. 14(*a*), is to be transferred, therefore, it is transferred generally straight, as shown in FIG. 14(*a*), for one side but with a skew, as shown in FIG. 14(*b*), for the other side. As a result, the positional relation between the produced images and the paper sheet is shown in FIG. 17(*a*) for one side but in FIG. 17(*b*) for the other side. When the paper sheet P bearing the images on its two sides is peered into, therefore, it is found, as shown in FIG. 17(*c*), that the image G1 on the surface and the image G2 on the back shear depending upon the cutting accuracy of the paper sheet P.

When printed matters are utilized as a pamphlet or when a double-side print such as a calling card is to be made by forming the same image on a plurality of portions of the same side of a paper sheet and then by cutting the paper sheet, for example, the shear between the front and back sides invites the shear from the center, extrusion or distortion of the image on the other side, if the paper sheet is cut with reference to one side. When the paper sheets having the produced images are bundled into a book, for example, on the other hand, the positional relation between the paper sheets and the images is dispersed to provide a poor appearance so that the printed matters lose the commercial value as the book.

SUMMARY OF THE INVENTION

The present invention provides an image forming apparatus capable of correcting the skew of a paper sheet being transferred, highly accurately without being influenced by the shape or cutting accuracy of the paper sheet.

The present invention also provides a paper bundling apparatus and a paper bundling method, which can make a bundle of paper sheets having images formed, without being degraded in quality by the influences such as the shape of the paper sheets or the paper cutting accuracy.

According to the present invention, the image forming apparatus comprises an image forming unit that forms an image on a paper sheet; and a paper transfer unit that transfers the paper sheet toward the image forming unit. The image forming apparatus also comprises a skew correcting unit that corrects the skew of the paper sheet transferred by the paper transfer unit, with reference to a paper end parallel to a transfer direction of the paper sheet and allows after the correction the paper sheet to reach the image forming unit without performing another skew correction.

In accordance with another aspect of the present invention, a paper bundling apparatus comprises an image forming unit that forms images on paper sheets; and a paper transfer unit that transfers the paper sheets toward the image forming unit. The paper bundling apparatus also includes: a skew correcting unit that corrects the skew of the paper sheets transferred by the paper transfer unit, with reference to paper ends parallel to a transfer direction of the paper sheets and allows after the correction the paper sheets to reach the image forming unit without performing another skew correction; and an align unit that bundles the paper sheets having the images formed by the image forming unit, by receiving and stacking the paper sheets having the images and by registering the paper ends, which were referred to by the skew correcting unit, at the stacking time.

According to another aspect of the present invention, the paper bundling method, using an image forming apparatus including an image forming unit for forming an image on a paper sheet, a paper transfer unit for transferring the paper sheet toward the image forming unit, and a skew correcting unit for correcting the skew of the paper sheet being transferred by the paper transfer unit, with reference to the paper end parallel to the transfer direction of the paper sheet, has the steps of causing the paper transfer unit to transfer the paper sheet toward the image forming unit, after the skew correcting unit corrected the skew of the paper sheet to be conveyed to the paper transfer unit, without performing another skew correction on the paper sheet, forming an image on the paper sheet, as corrected in its skew by the skew correcting unit, by the image forming unit when the corrected paper sheet reaches the image forming unit, making a bundle of the paper sheets having the images produced by the image forming unit, by receiving and stacking the paper sheets and by registering the paper ends which were referred to at the stacking time by the skew correcting unit, stitching the paper sheet bundle, folding the stitched paper sheet bundle with reference to the stitched portion, and cutting the folded paper sheet bundle at a portion near the end portion thereof.

According to the paper bundling apparatus having the aforementioned construction and the paper bundling method having the aforementioned procedure, the skew correction is made with reference to the paper end in parallel with the paper transfer direction such as the longer side end of the paper sheet, and after this correction, any other skew correction is not made on the paper sheet till the once-corrected paper sheet reaches the image transfer unit. Even when the paper sheet is not correctly cut at about 90 degrees at its leading end due to the influence of the cutting accuracy or the like, the skew of the paper sheet is regularly corrected. When the paper sheets having the images produced are to be stacked and bundled, the paper ends which were referred to at the skew correcting time are registered so that the positional relations between the paper sheets in the bundle and the images can be suppressed from dispersing. In other words, both at the time of forming the images and at the time of bundling the paper sheets, the positional relations between the paper sheets and the images to be produced thereon can be kept highly accurate. Moreover, this makes it possible to perform an after-treatment (e.g., a stitching action) easily and highly accurately.

BRIEF DESCRIPTION OF THE DRAWINGS

Preferred embodiments of the present invention will be described in detail based on the drawings.

DESCRIPTION OF THE PREFERRED EMBODIMENTS

With reference to the accompanying drawings, here will be described an image forming apparatus, a paper bundling apparatus and a paper bundling method for bundling paper sheets by using the image forming apparatus in accordance with the invention.

[First Embodiment]

Here will be described an image forming apparatus according to the invention.

Figure 1:
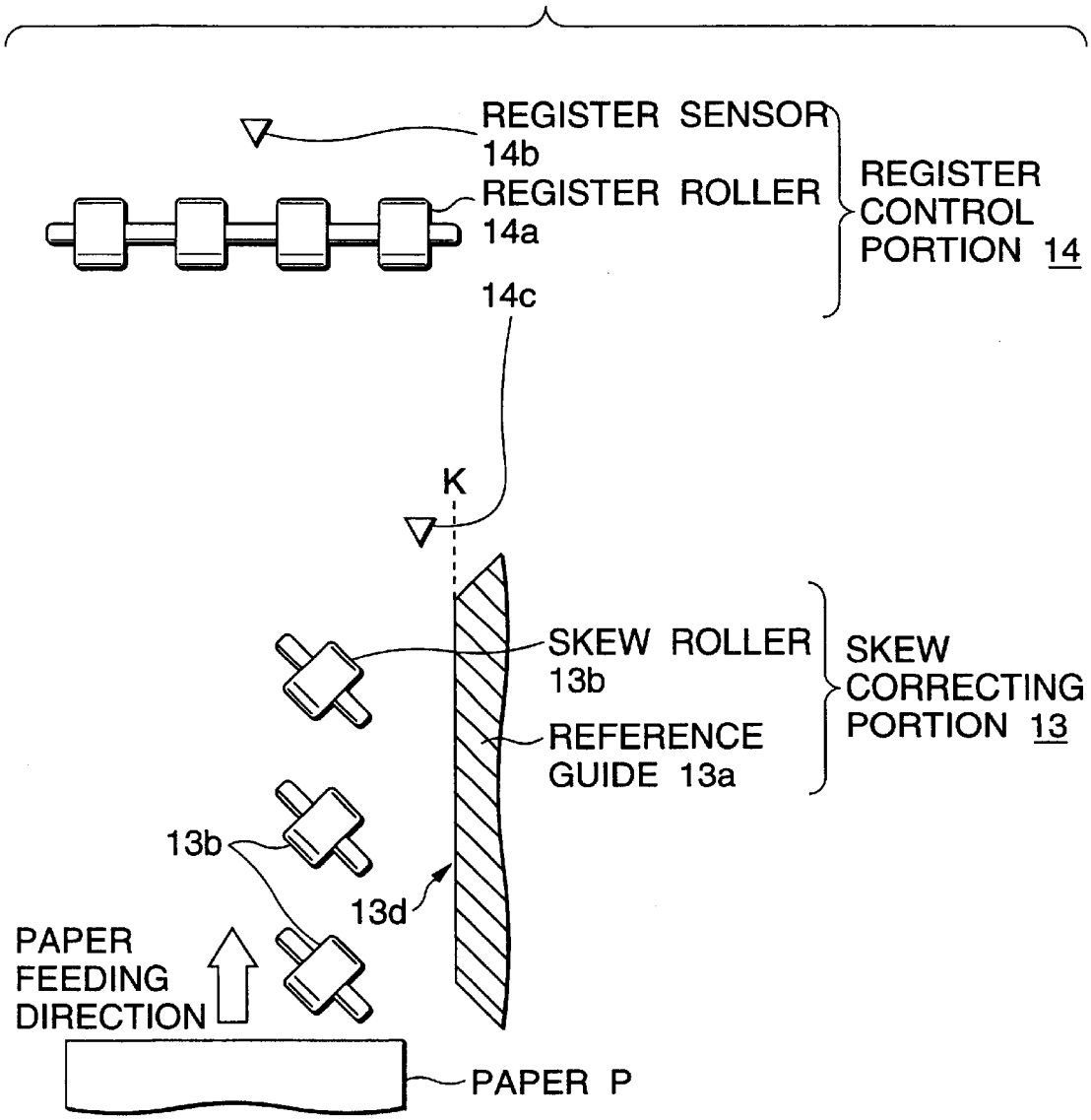
FIG. 1 is a schematic top plan view showing one embodiment of an essential portion of an image forming apparatus according to the invention.
Figure 2:
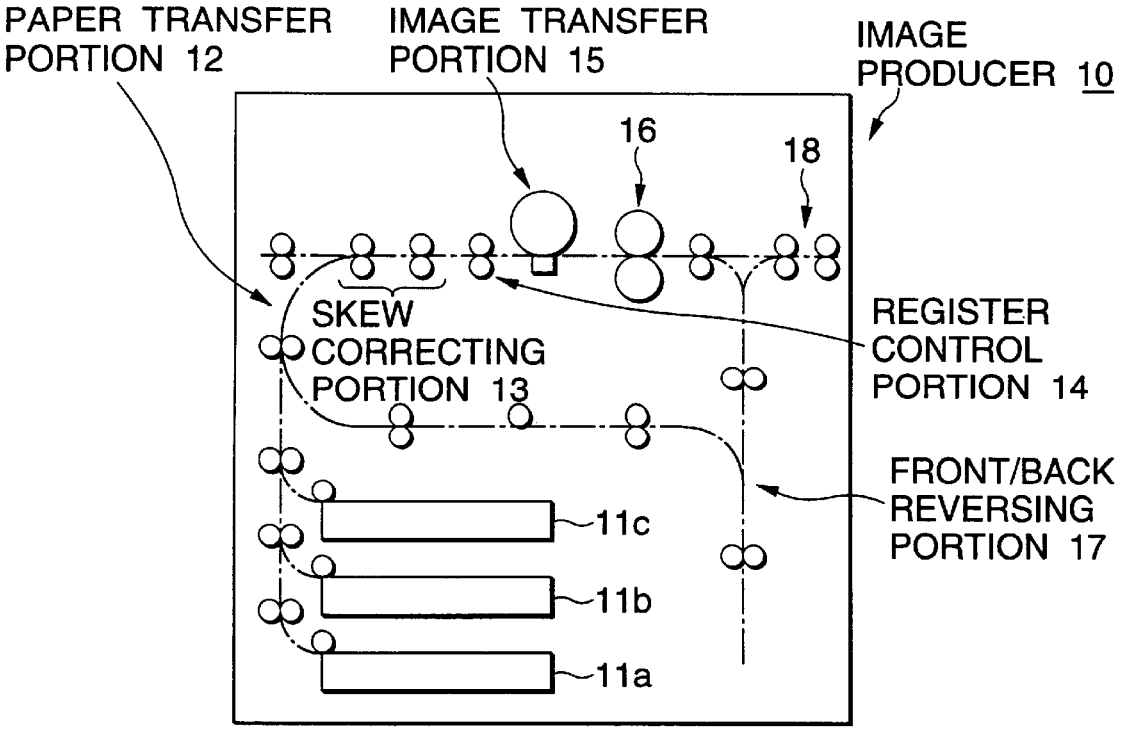
FIG. 2 is a schematic diagram showing an example of the entire construction of the image forming apparatus according to the invention.

FIG. 1 is a schematic top plan view showing one embodiment of an essential portion of an image forming apparatus according to the invention, and FIG. 2 is a schematic diagram showing an example of the entire construction of the image forming apparatus according to the invention.

The entire schematic construction of the image forming apparatus in this embodiment will be described first of all.

As shown in FIG. 2, an image forming apparatus 10 of this embodiment is constructed to include: a plurality of feed trays 11*a* to 11*c* for accommodating various sizes of sheets of paper individually; a paper transfer portion 12 for transferring the paper sheet fed from the individual feed trays 11*a* to 11*c;* a skew correcting portion 13 for correcting the skew of the paper sheet being transferred; a register control portion 14 for delivering the paper sheet skew-corrected by the skew correcting portion 13, at a predetermining timing; an image transfer portion 15 for transferring an image to the paper sheet delivered from the register control portion 14; a fixing portion 16 for fixing the image transferred to the paper sheet by the image transfer portion 15; a front/back reversing portion 17 for reversing the front/back sides of the paper sheet being transferred and for then delivering the reversed paper sheet again to the skew correcting portion 13; and a discharge portion 18 for discharging the image-produced paper sheet.

When an image is to be produced on the paper sheet in the image forming apparatus 10 thus constructed, the paper sheet of the size selected manually or automatically are fed from any of the individual feed trays 11*a* to 11*c,* the paper transfer portion 12 transfers the fed paper sheet toward the image transfer portion 15. The paper sheet thus transferred are corrected in their skew by the skew correcting portion 13 and then delivered to the register control portion 14. This register control portion 14 delivers the paper sheet at the timing to produce the image in the image transfer portion 15. As a result, the image is transferred to one side (as will be called the "first side") of the paper sheet delivered to the image transfer portion 15.

Then, the paper sheet bearing the image on its first side is delivered to the fixing portion 16, in which the image is fixed by the heat/pressure actions. In the case of a one-side printing (or a one-side copy for a copying machine), the paper sheet is then delivered from the fixing portion 16 to the discharge portion 18 so that it is discharged as it is from the image forming apparatus.

In the case of a perfecting printing or both-side printing (or a both-side copy for the copying machine), on the contrary, the paper sheet bearing the image transferred to its first side is delivered from the fixing portion 16 to the front/back reversing portion 17, in which the front and back are reversed by the switch-back method. The paper sheet thus reversed is delivered again to the skew correcting portion 13. From now on, the image is transferred to and fixed, like the aforementioned case, on the back side (as will be called the "second side") of the first side, and the paper sheet is then discharged from the image forming apparatus by the discharge portion 18.

Here in the image forming apparatus 10 thus constructed, the image transfer portion 15 may be exemplified either by the type in which a toner image produced on a photosensitive drum is transferred directly to the paper sheet or by the type in which the toner image on the photosensitive drum is transferred once to an image carrier belt such as an intermediate transfer belt and in which the toner image on the image carrier belt is then transferred to the paper sheet. Moreover, the image transfer portion 15 may also be exemplified either by the so-called "single drum type" having a single photosensitive drum or by the so-called "tandem type" having a plurality of photosensitive drums.

In this image forming apparatus 10, on the other hand, the front/back reversing portion 17 may resort, when it reverses the sides of the paper sheet by the switch-back method, either to the paper inverting method or to the dedicated both-side tray. In the case of using the paper inverting method, in the course from the image production of the first side to the image production of the second side, there is provided a paper reversing mechanism for quickly pulling out and delivering the trailing end of one of the paper sheets stacked, thereby to reverse the paper sides. In the case of using the dedicated both-side tray, on the contrary, the paper sheet having the image produced on its first side is once stocked in the dedicated both-side tray disposed in the front/back reversing portion 17 and is then taken out in the advancing direction, as reversed from that of the stocking time, thereby to invert the delivered side of the paper sheet.

With reference to FIG. 1, here will be described in detail the skew correcting portion 13 and the register control portion 14 in the image forming apparatus 10 thus constructed.

In this image forming apparatus 10, as shown, the skew correcting portion 13 is provided with a reference guide 13*a* and skew rollers 13*b*.

The reference guide 13*a* is disposed along the transfer direction (as indicated by arrow in FIG. 1) of the paper sheet P by the paper transfer portion 12 and at one end portion of the paper transfer passage and is provided with a paper reference face 13*d* parallel to the transfer direction of the paper sheet P so that it functions as a positioning member for the paper sheet P.

The skew rollers 13*b* are provided in plurality (e.g., three) along the transfer direction of the paper sheet P. These skew rollers 13*b* are arranged with individual inclinations of predetermined angles with respect to the transfer direction of the paper sheet P. On the other hand, the individual skew rollers 13*b* make pairs with the not-shown individual lower rollers. In other words, the skew rollers 13*b* function as approach unit for bringing the paper sheet P close to the reference guide 13*a* so that the paper sheet P transferred from the upstream may be brought at its side end into abutment against the paper reference face 13*d* of the reference guide 13*a*.

In the skew correcting portion 13 thus constructed, when the paper sheet P is transferred by the paper transfer portion 12 to reach the skew correcting portion 13, the skew rollers 13*b* nip (or grip) the paper sheet P at first. Since the skew rollers 13*b* are being rotated at this time by the drive of the not-shown drive source, the nipped paper sheet P is brought close to the reference guide 13*a*. As a result, the side end of the paper sheet P comes into abutment against the paper reference face 13*d* of the reference guide 13*a* so that the skew, as having occurred beforehand, of the paper sheet P is corrected.

At this time, on the other hand, it may be imagined that the paper sheet P is buckled, if it lacks firmness, at its side end portion by the bringing action of the skew rollers 13*b*. If the nipping force of the skew rollers 13*b* is adjusted according to the paper kind, however, the paper sheet P can be prevented from being buckled.

In this skew correcting portion 13, the paper sheet P, as transferred by the paper transfer portion 12, is corrected in its skew by using the reference guide 13*a* and the skew rollers 13*b,* as described above. On and subsequent to this, the paper sheet P is not subjected to the skew correction so far as it reaches the image transfer portion 15. Specifically, the skew correcting portion 13 makes no skew correction unlike the prior art with reference to the leading end of the paper sheet P once it made the skew correction on the paper sheet P with reference to the paper end parallel to the transfer direction of the paper sheet P.

Downstream, as taken in the paper transfer direction, of the skew correcting portion 13 for that skew correction, a register roller 14*a,* a register sensor 14*b* and a paper side end detecting sensor 14*c* are provided as the register control portion 14.

The register roller 14*a* is positioned downstream of the skew correcting portion 13 in the paper transfer direction and upstream of the image transfer portion 15 in the paper transfer direction. The register roller 14*a* is rotated to deliver the paper sheet P toward the image transfer portion 15 by the not-shown drive source while pinching the paper sheet P between itself and the not-shown pinch roller forced to contact therewith. Moreover, the register roller 14*a* can also be moved in the axial direction (generally perpendicular to the paper transfer direction) by the not-shown drive source while pinching the paper sheet P.

The register sensor 14*b* is positioned over the paper transfer passage between the register roller 14*a* and the image transfer portion 15 to detect the leading end of the paper sheet P being delivered by the register roller 14*a*. The register sensor 14*b* may be constructed of a photo sensor or the like by combining a light emitting element and a light receiving element, for example. Here, the drive source for rotating the register roller 14*a* controls the rotation of the register roller 14*a* on the basis of the result of detection of the register sensor 14*b*.

The paper side end detecting sensor 14*c* is positioned downstream of the reference guide 13*a* and at an inner side of the paper transfer passage by several millimeters than a position of abutment K (as indicated by a broken line) of the paper sheet P against the paper reference face 13*d* to detect the side end of the paper P transferred along the paper transfer passage. The paper side end detecting sensor 14*c* may be constructed of a photo sensor or the like by combining a light emitting element and a light receiving element, for example.

In the register control portion 14 thus constructed, the paper sheet P having been corrected in its skew by the skew correcting portion 13 is pinched, when transferred, as it is between the register roller 14*a* and the pinch roller and delivered downstream of the paper transfer direction without interrupting the register roller 14*a*. As a result, the paper sheet P to be transferred reaches the image transfer portion 15 without any later position change from the state in which it was corrected in its skew by the skew correcting portion 13.

In the register control portion 14, on the other hand, the register roller 14*a* then moves axially while pinching the paper sheet P to register the paper side end to a predetermined position. After the register roller 14*a* pinched the paper sheet P, more specifically, the register roller 14*a* starts a leftward movement, as seen in FIG. 1, and is stopped when it moves a predetermined stroke after detection of the paper side end by the paper side end detecting sensor 14*c*. This axial movement of the register roller 14*a* is ended by the time the leading end of the paper sheet P reaches the image transfer portion 15. As a result, even if the paper side end portion is buckled when the paper end is brought into abutment against the reference guide 13*a* by the skew correcting portion 13, the paper sheet P is delivered to the image transfer portion 15 while being accurately positioned at its side end with respect to the axial direction of the register roller 14*a*.

In the register control portion 14, however, the paper sheet P has to be delivered at a predetermined timing to the image transfer portion 15 so that the image may be transferred to a correct position on the paper sheet P by the image transfer portion 15. For this purpose, the register control portion 14 controls the delivery timing of the paper sheet P by the so-called "servo register method", in which the rotation of the register roller 14*a* is controlled while the leading end of the paper sheet P to be delivered to the image transfer portion 15 being positioned downstream of the register roller 14*a* in the paper transfer direction, i.e., between the register roller 14*a* and the image transfer portion 15.

Here will be described in detail the timing control of the servo register method to be used by the register control portion 14.

Figure 3:
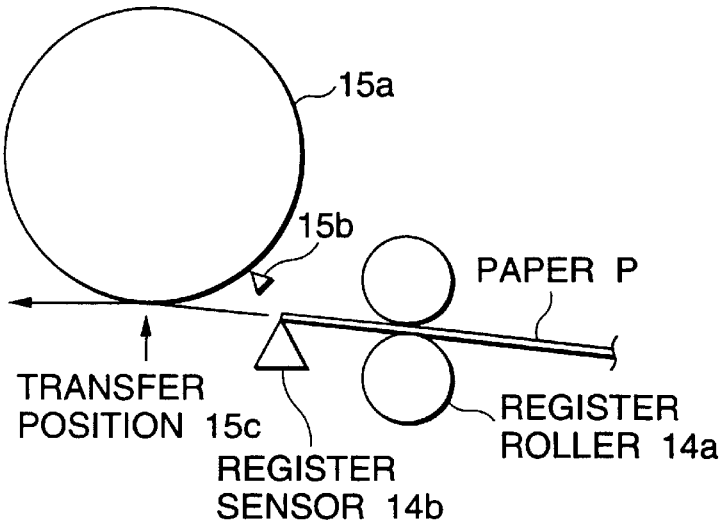
FIG. 3 is an explanatory diagram showing one example of the summary of the case in which a timing control by a servo register method was made in the image forming apparatus according to the invention.

FIG. 3 is an explanatory view showing the summary of the timing control by the servo register method.

Here, the servo register method is divided into the stop servo register method and the nonstop servo register method, either of which may be used for the timing control by the register control portion 14.

In the case of the timing control using the stop servo register method, the register control portion 14 performs the processing actions, as will be described in the following.

When the register sensor 14*b* detects the leading end of the paper sheet P, the register roller 14*a* once interrupts its rotation. After this, the register roller 14*a* restores its rotation in response to a predetermined signal synchronized with the image forming timing at the image transfer portion 15 thereby to reopen the delivery of the paper sheet P. The predetermined signal at this time can be exemplified either by a signal to be issued with a constant delay from the start of loading a photosensitive drum 15*a* with an electrostatic latent image or by a detection signal of the case in which a reference point (e.g., a toner patch) on the photosensitive drum 15*a* or an intermediate transfer belt is detected by a sensor 15*b* or the like.

By making the timing control by this stop servo register method, the register control portion 14 is enabled to bring the paper sheet P at a desired timing to a transfer position 15*c* of the image transfer portion 15 even if the leading end of the paper sheet P is positioned downstream of the register roller 14*a* in the paper transfer direction.

In the case of the timing control using the nonstop servo register method, on the other hand, the register control portion 14 performs the processing actions, as will be described in the following.

When the register sensor 14*b* detects the leading end of the paper sheet P, a control unit, as constructed of the not-shown CPU (Central Processing Unit) or the like, calculates a transfer velocity to deliver the paper sheet P, on the basis of both a predetermined signal synchronized with the image forming timing at the image transfer portion 15 and a distance between the register sensor 14*b* and the transfer position 15*c,* and instructs the drive source of the register roller 14*a* to deliver the paper sheet P at the transfer velocity. As a result, the register roller 14*a* is accelerated/decelerated in its rotating velocity in synchronism with the image forming timing at the image transfer portion 15 after the register sensor 14*b* detected the leading end of the paper sheet P.

By this nonstop servo register method, too, the register control portion 14 enables the leading end of the paper sheet P to reach the transfer position 15*c* of the image transfer portion 15 at the desired timing.

Here in the case of the timing control by the nonstop servo register method, the register sensor 14*b* is exemplified by two sensors (i.e., a first sensor and a second sensor) which are arranged along the paper transfer direction so that a more accurate timing control can be made by considering a difference between the detection timings of the two sensors.

In the image forming apparatus 10 of this embodiment thus far described, according to the invention defined in Claim 1, the paper, as transferred by the paper transfer portion 12, is corrected in its skew by the skew correcting portion 13 with reference to its end parallel to the transfer direction, e.g., its longitudinal side end but is not corrected any more till it reaches the image transfer portion 15.

According to this image forming apparatus 10, therefore, any skew, if involved in the paper transferred by the paper transfer portion 12, is regularly corrected by the skew correcting portion 13. After this correction, moreover, another skew correction is not made on the paper. Even when the leading end of the paper failed to be correctly cut at about 90 degrees due the influence of the cutting accuracy, for example, therefore, it is eliminated that the paper is transferred obliquely at a different angle. In other words, this image forming apparatus 10 can correct the skew of the paper regularly irrespective of the cutting accuracy before the paper reaches the image transfer portion 15.

Figure 4A:
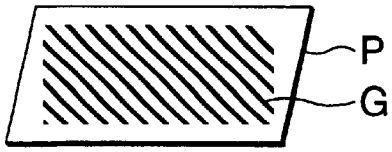
FIGS. 4(*a*) and 4(*b*) are explanatory diagrams individually showing specific examples when an image was produced on one side of the paper by using the image forming apparatus according to the invention.
Figure 4B:
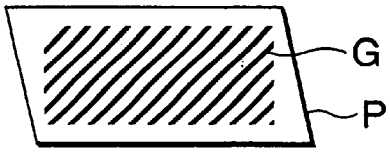

In this image forming apparatus 10, therefore, when an image is to be produced on one side of the paper sheet P, for example, the relation between the paper sheet P and the produced image G can be kept in parallel even if the paper sheet P is deformed into a parallelogram, as shown in FIGS. 4(*a*) and 4(*b*), due to a cutting error or the like. As a result, it is possible to avoid an extrusion of the image G from the paper sheet P or an extreme reduction in the marginal regions. As a result, no toner material scatters from the paper sheet P. Since the marginal regions of the paper sheet P can be stabilized, moreover, it is possible to reduce the setting extent itself of the marginal regions.

Figure 5A:
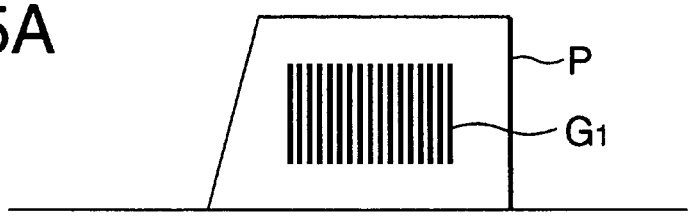
FIGS. 5(*a*), 5(*b*) and 5(*c*) are explanatory diagrams showing specific examples of a first side, a second side and a superposed state of the first and second sides, respectively, when images were produced on the two sides of the paper by using the image forming apparatus according to the invention.
Figure 5B:
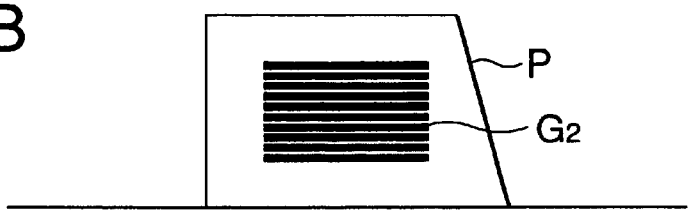
Figure 5C:
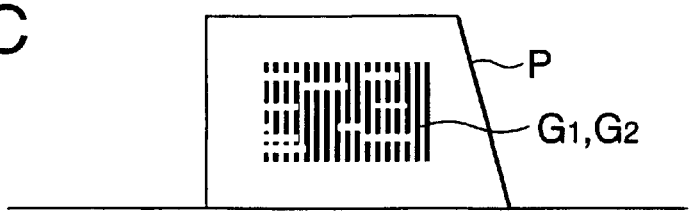

In this image forming apparatus 10, on the other hand, when the image G is to be produced on the two sides of the paper sheet P, the shear between an image G1 on the first side and an image G2 on the second side can be minimized, as shown in FIGS. 5(*a*) to 5(C), by making the skew corrections with reference to the same side end of the paper sheet P for the image transfer to the first side and for the image transfer to the second side. Even if the paper sheet P bearing the images G1 and G2 on its two sides is peered into, more specifically, the images will not shear unlike the prior art, depending upon the cutting accuracy of the paper sheet P. As a result, even when the paper sheet P bearing the two images is cut with reference to one side, the shear or the like will not occur on the other side. Thus, the image forming apparatus 10 is suitable for the printing of pamphlets or calling cards.

In short, in this image forming apparatus 10, the paper being transferred can be corrected in its skew without being influenced by its shape or cutting accuracy so that the image forming quality can be prevented from being lowered by such influence when the image is produced on one side or two sides of the paper.

According to alternative embodiments of the present invention, the image forming apparatus 10 of this embodiment is constructed to include the front/back reversing portion 17 for reversing the front and back sides of the paper, and this front/back reversing portion 17 is arranged upstream of the skew correcting portion 13 in the paper transfer direction.

As a result, in this image forming apparatus 10, even when an image is to be produced on the two sides of the paper, the image transfer portion 15 does not transfer the image to the paper before the skew correcting portion 13 makes the skew correction on that paper. At this time, moreover, the skew correcting portion 13 makes the skew correction with respect to the same side end of the paper, even when the front and back sides of the paper are reversed by the front/back reversing portion 17, before the image transfer to the first side and before the image transfer to the second side. As a result, this image forming apparatus 10 can reliably suppress the shear between the front and back sides when the image is produced on the two sides of the paper.

In the image forming apparatus 10 of this embodiment, the skew correcting portion 13 makes the skew correction on the paper sheet P by using the reference guide 13*a* and the skew rollers 13*b*. In other words, the skew correction is made with reference to the reference guide 13*a* or a fixed positioning member so that a highly accurate correction can be facilitated. By the action of the skew rollers 13*b*, moreover, the paper is brought close to the reference guide 13*a* while being delivered in the transfer direction, so that the skew correction can be quickly made.

In the image forming apparatus 10 of this embodiment, according to the inventions between defined in Claims 4 and 5, there is interposed the skew correcting portion 13 and the image transfer portion 15 the register control portion 14 for making the servo register type timing control, in which the register roller 14*a* and the register sensor 14*b* are used to make the rotation of the register roller 14*a* variable with the leading end of the paper being positioned downstream of the register roller 14*a* in the paper transfer direction.

In this image forming apparatus 10, therefore, it is unnecessary to stop the paper temporarily or to bring the same into abutment against the register roller 14*a* before the timing control at the register control portion 14. As a result, the paper to be delivered to the image transfer portion 15 reaches the transfer position 15*c* of the image transfer portion 15 at its leading end at a predetermining timing without any change in its position once its skew is corrected by the skew correcting portion 13.

Here, the servo register type timing control is exemplified by the stop servo register method and the nonstop servo register method. Ideally, it is desired to adopt the nonstop servo register method in which the timing for delivering the paper to the image transfer portion 15 is controlled without any stop. When the stop servo register method is adopted, the paper to be delivered to the image transfer portion 15 has to be once stopped. At the instants of the stop and the restart, therefore, a slight slip may occur between the register roller 14*a* and the paper. It is conceivable to suppress this slippage by enhancing the frictional force, rigidity or the like of the register roller 14*a*. However, the slippage is changed by the remaining disturbing factors such as the conditions for the image forming apparatus construction, the kind, thickness and weight of the paper and so on. In order to realize the highly accurate timing control uninfluenced by those disturbing factors, therefore, it is desired to adopt the nonstop servo register method requiring no stop of the paper.

[Second Embodiment]

Here will be described a paper bundling apparatus and a paper bundling method according to the invention.

Figure 6:
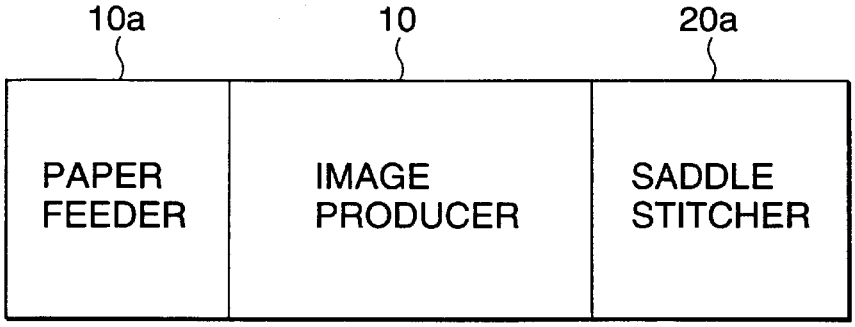
FIG. 6 is a schematic diagram showing an embodiment of a system construction of a paper bundling apparatus according to the invention.
Figure 7:
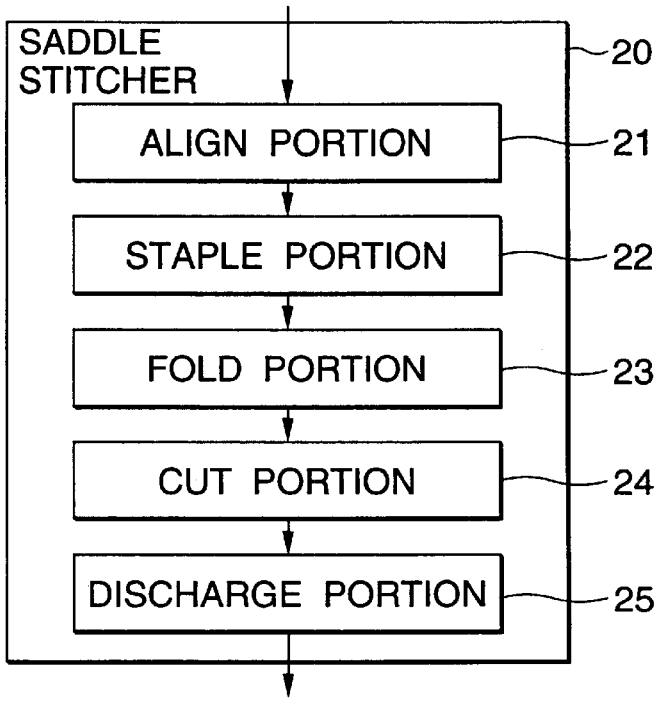
FIG. 7 is a block diagram showing a functional construction example of a saddle stitcher to be used in the paper bundling apparatus according to the invention.

FIG. 6 is a schematic diagram showing an embodiment of a system construction of a paper bundling apparatus according to the invention, and FIG. 7 is a block diagram showing a functional construction example of an essential portion of the paper bundling apparatus according to the invention.

As shown in FIG. 6, the paper bundling apparatus of this embodiment is constructed to include: an image forming apparatus 10 constructed, as has been described in connection with the first embodiment; a paper feeder 10*a* including a feed tray and a paper transfer portion for feeding a number of paper sheets sequentially to the image forming apparatus 10; and a saddle stitcher 20 for receiving and after treating the paper sheets on which images were produced in the image forming apparatus 10. Here, the paper feeder 10*a* need not be coupled.

Of these components, the saddle stitcher 20 is constructed, as shown in FIG. 7, to include: an align portion 21 for making a bundle of paper sheets by receiving and stacking the paper sheets bearing images from the image forming apparatus 10; a staple portion 22 for stitching the bundled paper sheets made in the align portion 21; a fold portion 23 for folding the paper sheet bundle stitched in the staple portion 22; a cut portion 24 for cutting the paper sheet bundle folded in the fold portion 23; and a discharge portion 25 for discharging the paper sheet bundle cut in the cut portion 24, to the outside of the paper bundling apparatus.

In the saddle stitcher 20 thus constructed, when a plurality of sheets of paper bearing images are discharged from the discharge portion 18 of the image forming apparatus 10, the align portion 21 produces a bundle of paper sheets by receiving the paper sheets sequentially and by stacking them on its not-shown stock tray. At this time, the align portion 21 stacks the paper sheets on the stock tray while registering them with the same paper side ends as were referred to by the skew correcting portion of the image forming apparatus 10 on 13.

Figure 8:
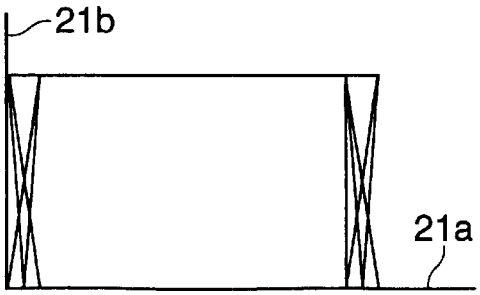
FIG. 8 is an explanatory diagram showing one example of the summary of the paper bundling apparatus of the saddle stitcher of FIG. 7.

As shown in FIG. 8, more specifically, at the time of stacking the paper sheets on the stock tray, the align portion 21 brings the same paper side ends as were referred to by the skew correcting portion 13 of the image forming apparatus 10 into abutment against a first aligning face 21*a* of the stock tray. At the same time, moreover, the align portion 21 brings the paper side ends adjoining the side ends which were caused to abut against the first aligning face 21*a*, in the stock tray into abutment against a second aligning face 21*b* perpendicular to the first aligning face 21*a*.

However, the first aligning face 21*a* has a higher dominating power than that of the second aligning face 21*b*. When the abutment of the paper sheets is caused by utilizing the slope of the stock tray, for example, the inclination for the first aligning face 21*a* is larger than that for the second aligning face 21*b*. When the abutment of the paper sheets is caused by utilizing drive rollers or the like, on the other hand, the driving force for the first aligning face 21*a* is stronger than that for the second aligning face 21*b*.

As a result, the paper sheets in the stock tray are so stacked that the same paper side ends referred to by the skew correcting portion 13 of the image forming apparatus 10 are held in close contact with the first aligning face 21*a* of the stock tray. In other words, the paper sheets, as stacked in the stock tray, are registered with reference to the same paper side ends which were referred to by the skew correcting portion 13 of the image forming apparatus 10, so that the paper sheets are bundled while being kept parallel in themselves and in the images thereon.

When a predetermined number of paper sheets are thus bundled in the align portion 21, the staple portion 22 of the saddle stitcher 20 then staples the paper sheet bundle.

Figure 9:
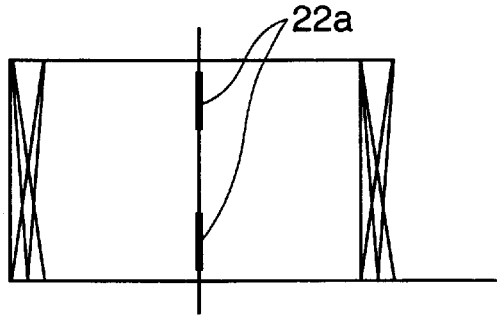
FIG. 9 is an explanatory diagram showing one example of the summary of a stitching action in the saddle stitcher of FIG. 7.

As shown in FIG. 9, more specifically, the staple portion 22 staples the paper sheet bundle in the stock tray with staple needles 22*a* while fixing the bundle immovably by unit of the not-shown fixing rollers or the like. In the saddle stitching case for stapling the general center of the paper sheet bundle, for example, the staple portion 22 is moved to a position corresponding to the general center of the paper sheet bundle in accordance with the paper size in the stock tray and then staples predetermined positions (e.g., two positions) with the staple needles 22*a*. As a result, the paper sheet bundle in the stock tray is integrated.

Subsequent to the end of the stitching action at the staple portion 22, the fold portion 23 of the saddle stitcher 20 performs a folding action on the integrated paper sheet bundle.

Figure 10A:
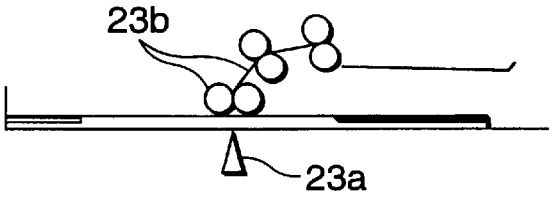
FIGS. 10(*a*)and 10(*b*)are side elevations showing states before and after a folding action of an example of the schematic construction of a fold portion in the saddle stitcher of FIG. 7.
Figure 10B:
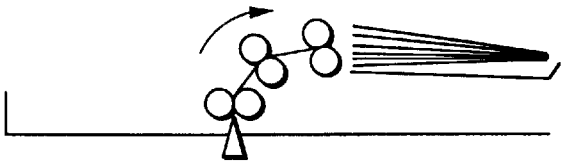

As shown in FIG. 10(*a*), more specifically, when the fold portion 23 performs the folding action on the paper sheet bundle in the stock tray, it protrudes at first a folding knife 23*a*, as disposed at one side (e.g., the lower side) of the stock tray, into the stock tray at a portion corresponding to the stitching position (or the general center of the paper sheet bundle) of the staple portion 22 while releasing the paper sheet bungle from the fixation of the fixing rollers or the like. By this protruding action of the folding knife 23*a*, the paper sheet bundle in the stock tray is pushed at its stitched position (or its general center) into the clearance between paired folding rolls 23*b* disposed on the side confronting the folding knife 23*a*. At this time, the paired folding rolls 23*b* are being rotated. As a result, the paper sheet bundle, as pushed between the paired folding rolls 23*b*, is delivered in the direction of arrow, as shown in FIG. 10(*b*), as the rolls are driven to rotate.

Figure 11:
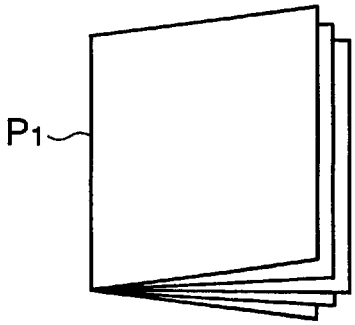
FIG. 11 is an explanatory diagram showing one example of the summary of the folding action in the saddle stitcher of FIG. 7.

As a result, the paper sheet bundle in the stock tray is folded into halves, as shown in FIG. 11, with reference to the stitching position (or on the folding axis) at the staple portion 22. Thus, the halved paper sheet bundle is delivered to the cut portion 24.

This cut portion 24 receives the halved paper sheet bundle, as delivered from the fold portion 23, and stores it once in the not-shown cutting tray. At this time, the cut portion 24 positions the paper sheet bundle with reference to the folded end P1 of the halved paper sheet bundle prepared by the fold portion 23. This positioning can be performed by bringing the folded end P1 of the paper sheet bundle into abutment against one wall face of the cutting tray, for example. When this halved bundle is positioned in the cutting tray, moreover, the not-shown cutter blade, which is directed normal to the paper sheet stacking face of the cutting tray, is protruded into the cutting tray while the paper sheet bundle being fixed by the not-shown fixing rollers or the like.

Figure 12:
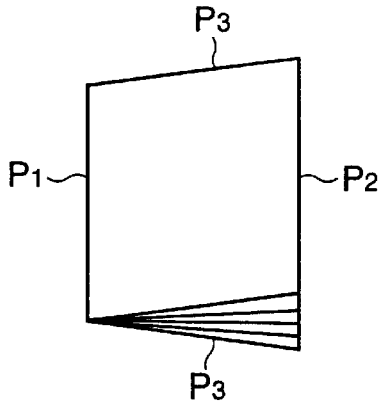
FIG. 12 is an explanatory diagram showing one example of the summary of a cutting action in the saddle stitcher of FIG. 7.

As a result, the paper sheet bundle in the cutting tray is cut off at its edges (i.e., the neighborhoods of the end portions) other than the folded end, as shown in FIG. 12. Here, this cutting-off actions may be performed not only on one side P2 opposed to the folding end of the paper sheet bundle but also all the three sides P2 and P3 other than the folded end. In this saddle stitcher 20, it can be arbitrarily set which side of the paper sheet bundle is to be cut.

When the stitching of the paper sheet bundle is thus ended, moreover, a discharge portion 25 of the saddle stitcher 20 discharges the paper sheet bundle to the outside of the paper bundling apparatus.

In the paper bundling apparatus of this embodiment thus far described, according to the inventions defined in claims 7 and 11, at the time of forming the image on the paper sheet in the image forming apparatus 10, the skew correction is made with reference to the paper end parallel to the paper transfer direction, e.g., to the longer side end of the paper sheet, and at the time of stacking paper sheets in the saddle stitcher 20, the paper sheets are bundled by registering them with the paper ends which were referred to at the skew correcting time in the he image forming apparatus 10.

If the paper sheets are bundled by using the paper bundling apparatus, therefore, the image can be produced in a high quality without any extrusion over the paper sheet even when the paper sheet fails to be correctly cut in shape due to the cutting error or the like. In addition, the parallelism between the paper sheets and the parallelism between the images produced over the paper sheets can be held highly accurate to prevent the paper sheets and the images from dispersing in the paper sheet bundle.

Figure 13A:
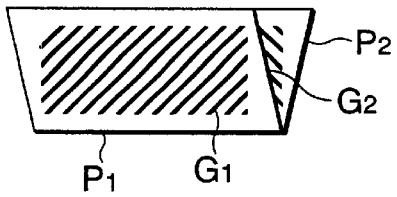
FIGS. 13(*a*) and 13(*b*) are diagrams for explaining examples of making a bundle of paper, respectively, by using a paper bundling apparatus according to the invention and the prior art.
Figure 13B:
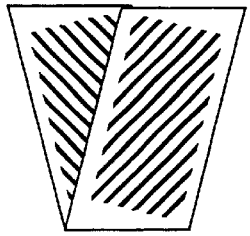
FIG.13B PRIOR ART
Figure 14:
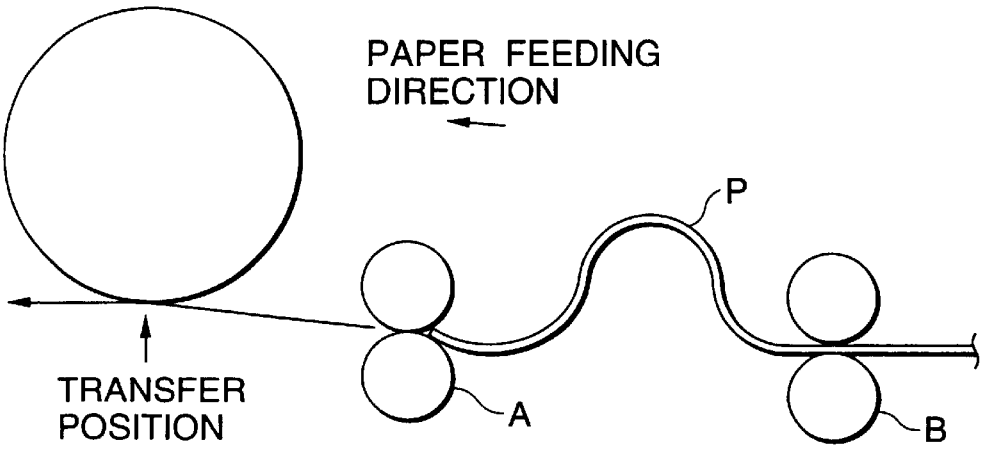
FIG.14 PRIOR ART
FIG. 14 is a schematic side elevation showing one example of an essential portion of the image forming apparatus of the prior art.
Figure 15A:
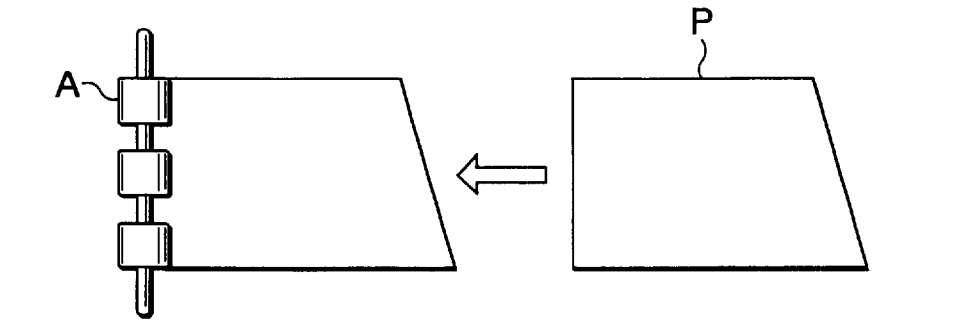
FIG.15A PRIOR ART
FIGS. 15(*a*) and 15(*b*) are explanatory diagrams showing the summaries of the skew correction of the paper in the image forming apparatus of the prior art, respectively, when the leading end of paper was and was not correctly cut.
Figure 15B:
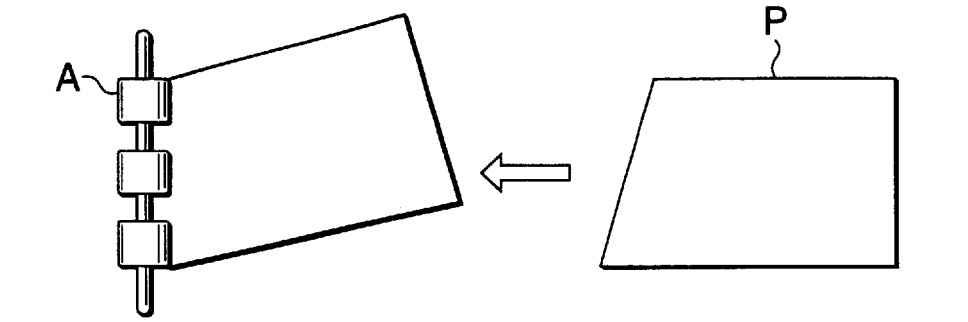
FIG.15B PRIOR ART
Figure 16A:
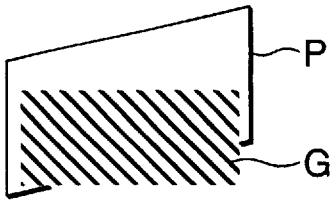
FIG.16A PRIOR ART
FIGS. 16(*a*) and 16(*b*) are explanatory diagrams of specific examples individually when an image was produced on one side of paper by using the image forming apparatus of the prior art.
Figure 16B:
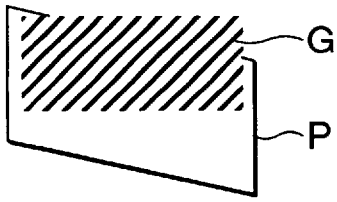
FIG.16B PRIOR ART
Figure 17A:
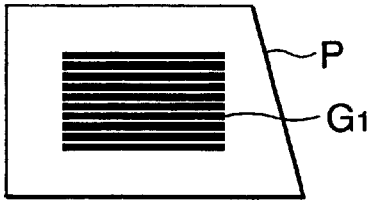
FIG.17A PRIOR ART
FIGS. 17(*a*), 17(*b*) and 17(*c*) are explanatory diagrams showing specific examples of a first side, a second side and a superposed state of the first and second sides, respectively, when images were produced on the two sides of the paper by using the image forming apparatus of the prior art.
Figure 17B:
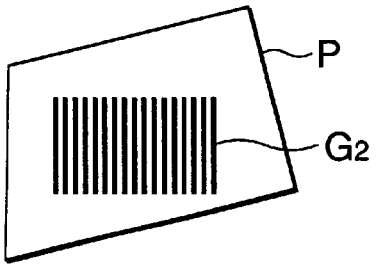
FIG.17B PRIOR ART
Figure 17C:
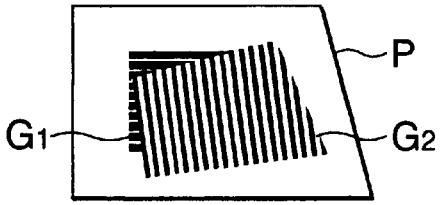
FIG.17C PRIOR ART

As shown in FIG. 13(*a*), more specifically, the parallelisms are held between the individual paper sheets P1 and P2 and between the images G1 and G2 produced on the individual paper sheets P1 and P2, and the repetition accuracy of these positional relations is drastically improved. Unlike the prior art (in which the skew corrections and the registers at the stacking time are performed with respect to the leading ends of the paper sheets), as shown in FIG. 13(*b*), there is no dispersion in the positional relations of the paper sheets and the images.

As a result, the paper sheet bundle can keep a high accuracy of the positional relations between the paper sheets and the images produced thereon so that the images on the front and back sides or the images on one paper sheet and another are superimposed without any shear to provide no poor appearance.

Especially in the paper bundling apparatus of this embodiment, according to the inventions defined in claims 8, 9, 10 and 11, the prepared paper sheet bundle is subjected to the after-treatments such as the stitching actions and the cutting actions. In these after-treatments, however, the positional relations between the paper sheets and the images can be held highly accurate to make the stitching action, the cutting actions and so on easy and highly accurate.

Even when the paper sheet bundle is to be stitched into a book by after-treating it, on the other hand, it is possible, unlike the prior art, to prevent the book from losing its commercial value. When the paper sheet bundle is utilized as a pamphlet or when a double-side print such as a calling card is to be made by forming the same image on a plurality of portions of the same side of a paper sheet and then by cutting the paper sheet, on the other hand, the image of the other side is prevented from any shear from the center, extrusion or distortion, even if the paper sheet is cut with reference to one side. Even when the paper sheet bundle is utilized as a booklet, moreover, a finish of high quality can be achieved.

Here, this embodiment has been described by exemplifying the case in which the paper sheet bundle prepared by the saddle stitcher 20 is stitched, folded and cut sequentially in the recited order. However, the invention should not be limited thereto, but it is natural that any of those actions may be arbitrarily made or that another after-treatment (e.g., a punching treatment) may be taken.

As has been described hereinbefore, the image forming apparatus of the invention makes the skew correction with reference to the paper end in parallel with the paper transfer direction but does not make any other skew correction on the paper sheet till the once-corrected paper sheet reaches the image transfer unit. As a result, the paper sheet being transferred is regularly corrected in its skew. In addition, even when the paper sheet is not correctly cut in shape due to the influence of the cutting accuracy or the like, it is prevented from being turned and transferred at an inclination.

In this image forming apparatus, therefore, when an image is to be produced on one side of the paper sheet, for example, the paper sheet and the image to be produced thereon can be held in a parallel relation to avoid the extrusion of the image from the paper sheet or the extreme reduction in the paper marginal regions irrespective of the paper cutting accuracy or the like. Even when images are to be produced an the two sides of the paper sheet, on the other hand, the skew corrections are made with reference to the same side end of the paper sheet for both the image transfers to the first side and the second side, so that the shear between the images on the first and second sides is minimized. In other words, no shear occurs, as might otherwise depend upon the paper cutting accuracy, in the images produced on the front and back sides of the paper sheet. In this image forming apparatus, more specifically, the skew of the paper sheet being transferred can be corrected without being influenced by the shape or cutting accuracy of the paper sheet, so that the image forming quality can be prevented from being degraded by those influences not only for forming an image on one side of the paper sheet but also for forming images on the two sides of the paper sheet.

In the paper bundling-apparatus and the paper bundling method of the invention, on the other hand, when an image is to be produced on a paper sheet, the skew correction is made with reference to the paper end parallel to the paper transfer direction. When the paper sheets are to be bundled by stacking them bearing the images, moreover, the paper ends, as referred to at the skew correcting time, are registered.

In these paper bundling apparatus and paper bundling method, therefore, it is possible to suppress the dispersion of the positional relations between the paper sheets and the images in the paper bundle. Even when the paper bundle is to be stitched, more specifically, either the images on the front and back sides or the images on one paper sheet and another are superimposed without any shear to provide no poor appearance. Unlike the prior art, the book will not lose its commercial value due to the influences of the paper cutting accuracy or the like. Accordingly, the paper bundling apparatus and the paper bundling method can be suitably applied to the case in which the paper sheet bundle is utilized as a pamphlet or in which a double-side print such as a calling card is to be made by forming the same image on a plurality of portions of the same side of a paper sheet and then by cutting the paper sheet.

What is claimed is:

1. An image forming apparatus, comprising:

an image forming unit that forms an image on a paper sheet;

a paper transfer unit that transfers the paper sheet toward the image forming unit;

a skew correcting unit that corrects the skew of the paper sheet transferred by the paper transfer unit, with reference to a paper end parallel to a transfer direction of the paper sheet and allows after the correction the paper sheet to reach the image forming unit without performing another skew correction; and a register control portion that registers the paper sheet by using a register roller that moves in a direction perpendicular to a path of the paper sheet in order to register the paper sheet to a predetermined position.

2. The image forming apparatus according to claim 1, further comprising:

a front/back reversing unit that receives the paper sheet having the image formed by the image forming unit, reverses the front and back of the received paper sheet and transfers the reversed paper sheet to the paper transfer unit, wherein the front/back reversing unit is arranged upstream of the skew correcting unit in the paper transfer direction by the transfer unit, so that the skew correction unit corrects the skew of the reversed paper sheet transferred by the paper transfer unit from the front/back reversing unit to the image forming unit.

3. The image forming apparatus according to claim 1, wherein the skew correcting unit comprises:

a positioning member disposed in parallel with the paper transfer direction by the transfer unit; and an approach unit that brings the paper sheet being transferred by the transfer unit, close to the side of the positioning member.

4. The image forming apparatus according to claim 1, wherein said register control portion receives the paper sheet having been corrected in its skew by the skew correcting unit and controls a timing at which the paper sheet is to be delivered to the image forming unit.

5. The image forming apparatus according to claim 4, wherein the register control portion comprises:

a register roller arranged between the skew correcting unit and the image forming unit; and a rotation control unit that adjusts the delivery timing of the paper sheet to be delivered to the image forming unit, when a leading end of the paper sheet is positioned between the register roller and the image forming unit, by changing the rotation of the register roller.

6. The image forming apparatus according to claim 5, wherein the rotation control unit adjusts the delivery timing of the paper sheet to be delivered to the image forming unit, without stopping the paper sheet by changing the rotating velocity of the register roller.

7. A paper bundling apparatus, comprising:

an image forming unit that forms images on paper sheets;

a paper transfer unit that transfers the paper sheets toward the image forming unit;

a skew correcting unit that corrects the skew of the paper sheets transferred by the paper transfer unit, with reference to paper ends parallel to a transfer direction of the paper sheets and allows after the correction other paper sheets to reach the image forming unit without performing another skew correction;

a register control portion that registers the paper sheet by using a register roller that moves in a direction perpendicular to a path of the paper sheet in order to register the paper sheet to a predetermined position; and an align unit that bundles the paper sheets having the image formed by the image forming unit, by receiving and stacking the paper sheets having the images and by registering the paper ends, which were referred to by the skew correcting unit, at the stacking time.

8. The paper bundling apparatus according to claim 7, further comprising:

a staple unit that stitches a paper sheet bundle made by the align unit.

9. The paper bundling apparatus according to claim 7, further comprising:

a fold unit that folds a paper sheet bundle made by the align unit.

10. The paper bundling apparatus according to claim 7, further comprising:

a cut unit that cuts a paper sheet bundle made by the align unit.

11. A paper bundling method using an image forming apparatus having an image forming unit that forms an image on a paper sheet, a paper transfer unit that transfers the paper sheet toward the image forming unit, a skew correcting unit that corrects the skew of the paper sheet transferred by the paper transfer unit, with reference to the paper end parallel to a transfer direction of the paper sheet and a register control portion, comprising the steps of:

causing the paper transfer unit to transfer the paper sheet toward the image forming unit, after the skew correcting unit corrected the skew of the paper sheet to be conveyed to the paper transfer unit, without performing another skew correction on the paper sheet;

registering the paper sheet using a register roller of the register control portion that moves in a direction perpendicular to a path of the paper sheet to register the paper to a predetermined position;

forming an image on the paper sheet, as corrected in its skew by the skew correcting unit, by the image forming unit when the corrected paper sheet reaches the image forming unit;

making a bundle of the paper sheets having the images formed by the image forming unit, by receiving and stacking the paper sheets and by registering the paper ends which were referred to at the stacking time by the skew correcting unit;

stitching the paper sheet bundle;

folding the stitched paper sheet bundle with reference to the stitched portion; and cutting the folded paper sheet bundle at a portion near the end portion thereof.

* * * * *